United States Patent [19]

Kreuzer

[11] 4,239,218

[45] Dec. 16, 1980

[54] BASKETBALL TABLE GAME

[76] Inventor: Andreas Kreuzer, Rossbergstrasse 53, D-7022 Leinfelden-Echterdingen, Fed. Rep. of Germany

[21] Appl. No.: 972,620

[22] Filed: Dec. 22, 1978

[51] Int. Cl.[3] ..... A63F 7/06; A63F 7/24

[52] U.S. Cl. ..... 273/85 E

[58] Field of Search ..... 273/85 A, 85 E, 95 E

[56] References Cited

U.S. PATENT DOCUMENTS

| | | | |
|---|---|---|---|
| 1,821,918 | 9/1931 | Bishop | 273/85 E |
| 1,917,700 | 7/1933 | Clark | 273/85 E |
| 2,343,506 | 3/1944 | Hay | 273/95 E |
| 2,611,615 | 9/1952 | Watson et al. | 273/95 E X |
| 2,783,754 | 3/1957 | Heiss | 273/85 A UX |
| 3,901,508 | 8/1975 | Spangler | 273/85 E X |
| 4,052,064 | 10/1977 | Kennoy | 273/95 E X |

FOREIGN PATENT DOCUMENTS

| | | | |
|---|---|---|---|
| 1728320 | 9/1968 | Fed. Rep. of Germany . | |
| 1094581 | 12/1954 | France | 273/85 E |
| 297880 | 6/1954 | Switzerland | 273/85 E |
| 417353 | 10/1934 | United Kingdom | 273/85 E |
| 1181038 | 2/1970 | United Kingdom | 273/85 E |

*Primary Examiner*—Paul E. Shapiro

*Attorney, Agent, or Firm*—Schwartz, Jeffery, Schwaab, Mack, Blumenthal & Koch

[57] ABSTRACT

A basketball table game is disclosed in which the playing field has an uneven surface including a plurality of depressions. In use, a ball placed on the playing field will always roll into a depression. Ejectors are provided in each of the depressions for imparting a throwing motion to the ball to propel it toward a goal.

15 Claims, 11 Drawing Figures

BASKETBALL TABLE GAME

BACKGROUND

1. Field of the Invention

The invention concerns a basketball table game with a playing field having suspended baskets on both sides and being equipped with devices for throwing the ball.

2. Description of the Prior Art

Basketball table games of this type are known (DT-OS 17 28 320). However, their approximation of a real basketball table game is highly imperfect, because during the playing of the game a location is determined by the throwing of dice and the shifting of player figures. A rocker is then placed by the player in the determined location. A ball is to be thrown into a basket at the edge of the playing field by means of the rocker.

SUMMARY

It is the object of the invention to further improve a basketball table game of the type described hereinabove so that there is participation by the players in the game from the outside by means of an activating lever and so that the game is provided with devices which permit the closest possible approximation of the actual game of basketball through skill demonstrated in the operation of the devices.

According to the present invention, the object is attained by a device wherein the playing field comprises depressions or troughs and is shaped unevenly so that a ball placed upon the field always rolls into a depression. An ejector is provided in each of the depressions. The invention further concerns several additional advantageous improvements.

That is, the basketball table game of the present invention includes a playing field in a generally horizontal plane, the playing field having an upper surface and opposite ends. Basket goals are located at the opposite ends. The upper surface of the playing field includes a plurality of depressions, the depressions providing unevenness in the playing field in the vertical direction, whereby a ball placed upon the playing field always rolls into a depression. In each depression is a basketball ejector.

According to more specific aspects of the invention, each of the ejectors includes recesses for receiving a ball in a precise position. Also included is means for abruptly displacing the ejector in the upward direction to produce a throwing motion and for rotating the ejector for establishing a throwing direction. The recesses of each ejector are in the form of grooves and are arranged obliquely with respect to the plane of the playing field. Each of said ejectors is shaped for rotation with respect to the playing field, each ejector being engaged eccentrically by an associated, longitudinally movable lever. A ball and socket joint connects one of the levers with each ejector. A jack is coupled with each of the levers and the playing field to support each lever for rocking movement. A depressible activating handle is disposed adjacent one end of each lever. Each jack includes a groove, the associated lever being supported in the groove so that the lever is movable in a longitudinal direction. The playing field has a pair of lateral sides. The depressions, and the ejectors and handles associated therewith, include two groups, the handles of one group being arranged at one lateral side of the playing field and the handles of the other group being arranged at the other lateral side of the playing field. Biasing means are coupled with each lever for maintaining each lever in an initial position. The playing field is provided by a plate, a compressible material on the plate, and a cloth or plastic cover stretched over the compressible material. A supporting body may be arranged rotatably in the plate. The plate has a bottom side, and the plate may include slits on the bottom side in which case the levers are arranged in the slits. Table legs are arranged swivelably on the plate of the playing field. A net surrounds the playing field.

Examples of the invention will be described hereinafter by means of the drawings attached hereto.

DETAILED DESCRIPTION OF THE PREFERRED EMBODIMENT

Figure 1:
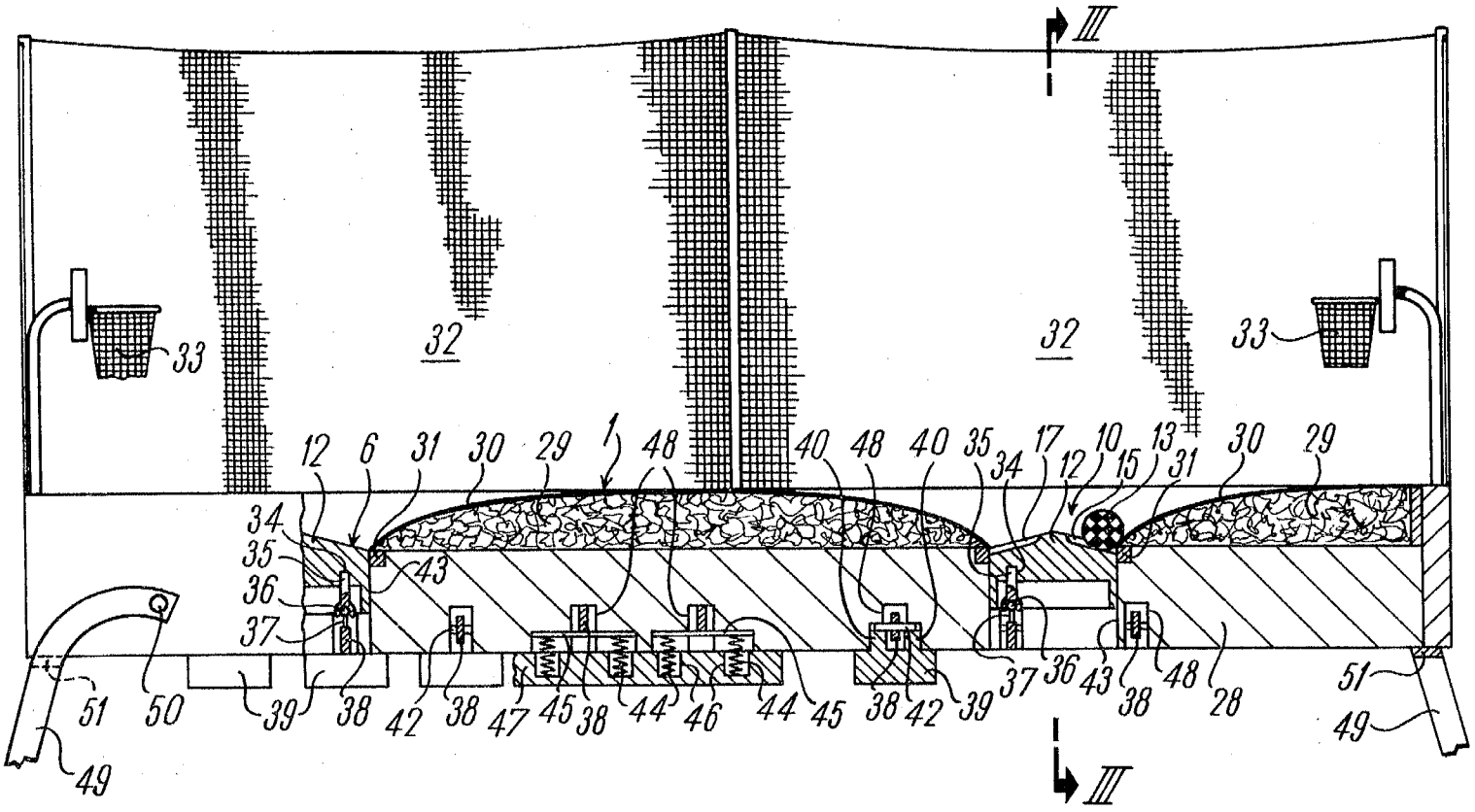
FIG. 1 represents a section through an exemplary embodiment (corresponding to line I—I in FIG. 2).
Figure 2:
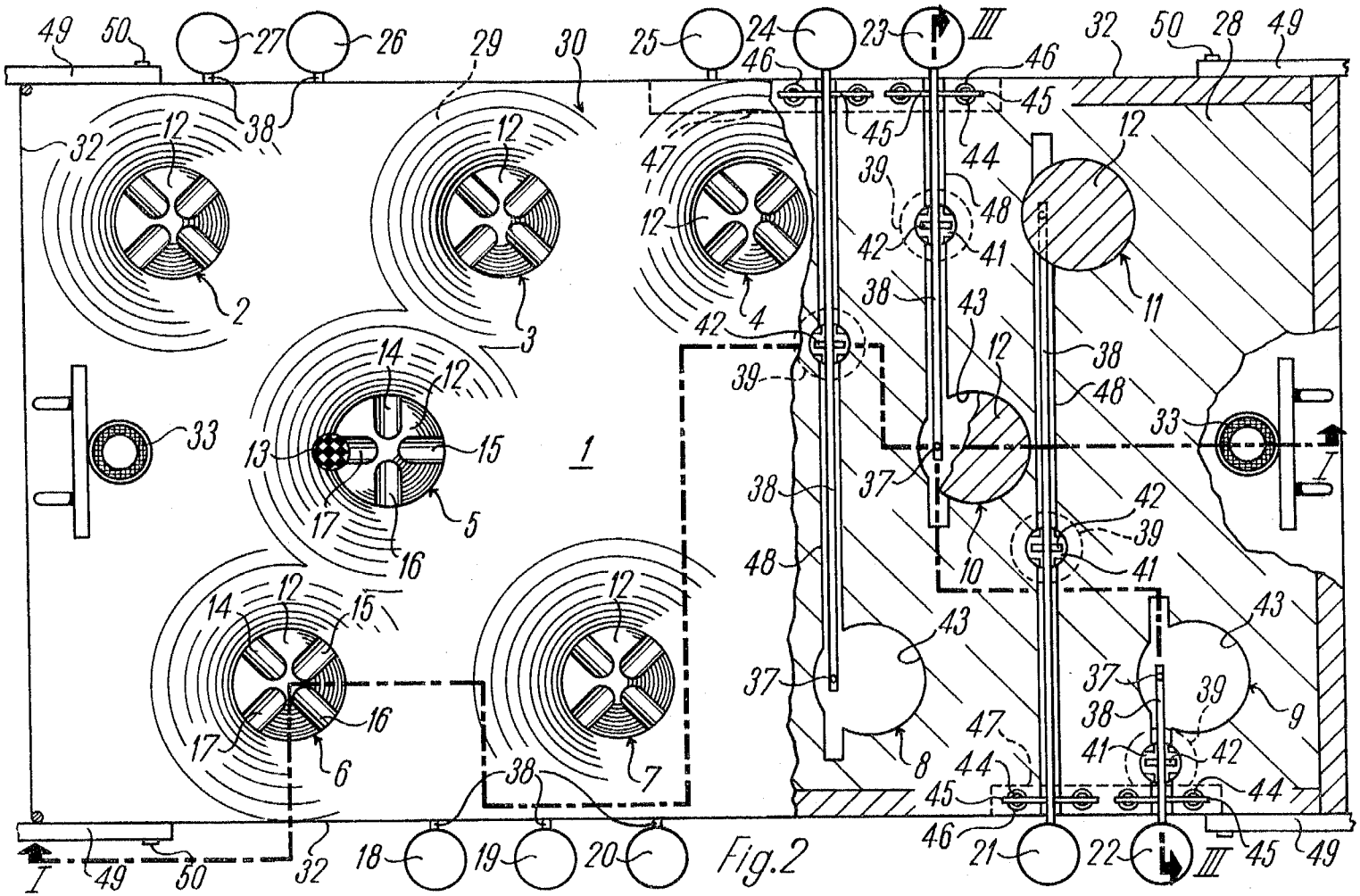
FIG. 2 is a top view with a partially removed top side of the exemplary embodiment of FIG. 1.
Figure 3:
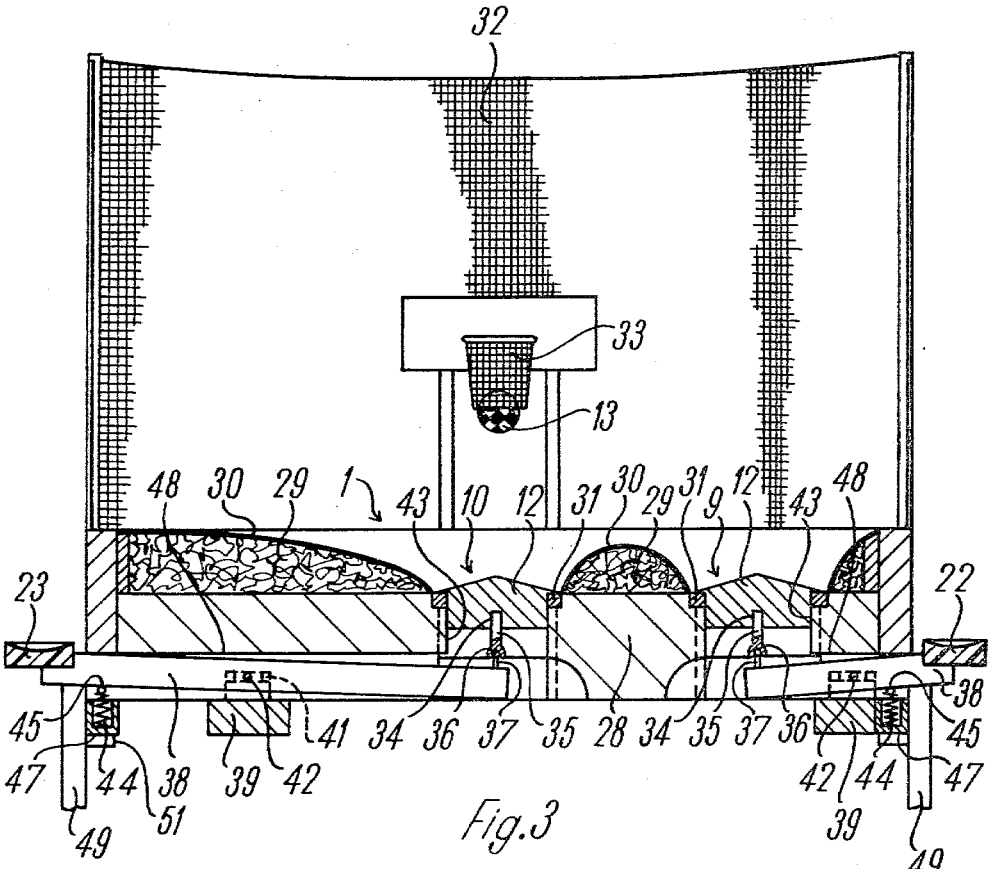
FIG. 3 is a section along the line III—III in FIG. 2.

The playing field, generally designated by reference character 1 (FIGS. 1 to 3) comprises several gradually sloping depressions or troughs 2 to 11, an ejector 12 being arranged in each of the depressions. A ball 13 which is brought into play, i.e. which is placed on any point of the playing field 1, will therefore roll into one of the depressions 2 to 11 and from there onto an ejector 12. The ball 13 is received on the upper side of the ejector 12 by one of four oblique groove-like recesses 14 to 17 (in FIG. 2 by the recess 17). As the result of this oblique configuration, the ball 13 is received in an accurately defined manner at the edge of the ejector. Associated with every ejector 12 in each of the depressions 2 to 11 is an activating levers 18–27, the activating levers being arranged along the longitudinal sides of the playing field and outside of the playing field. As will be shown hereinafter, the ejectors may be rotated and impactingly pressed upward by the activating levers. The impact-like upward pressure produces a throw, the exit direction of which is determined by the rotational position of the ejector 12 holding the ball.

During a game, one player plays with the activating levers 18 to 22 associated with ejectors in the depressions 5, 3, 7, 11 and 9, while the other player plays with the activating handles 23 to 27 on the other side of the playing field and associated with the ejectors in the depressions 10, 6, 4, 3, 2.

The playing field 1 is constructed by placing on a plate 28 a compressible material 29, e.g. a foam material, to be covered in turn by a cloth or a plastic cover 30, or the like, which is held in place by the framing pieces 31 in the manner shown. A net 32 surrounds the playing field 1. The baskets 33 are provided on both of the front sides.

Figure 4A:
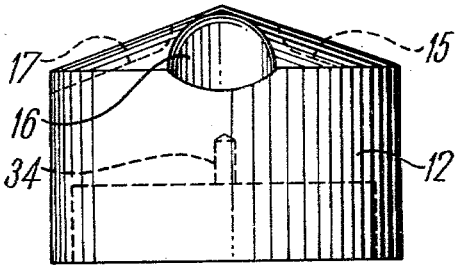
FIGS. 4*a, b* and *c* provide, respectively, a front view, side view and top view of an ejector.
Figure 4B:
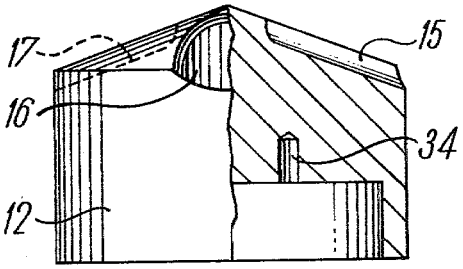
Figure 4C:
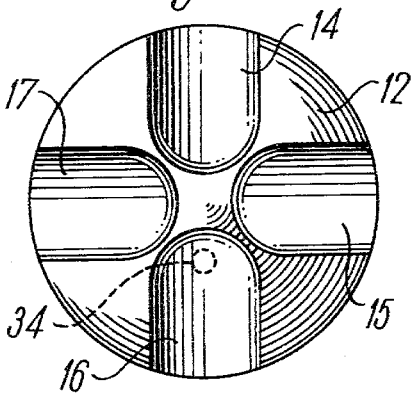
Figure 5A:
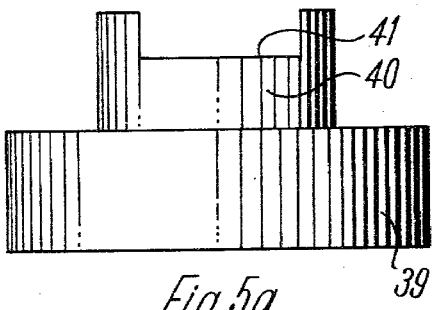
FIGS. 5*a, b* and *c* provide, respectively, a front view, side view and top view of a jack to support a lever for the activation of an ejector.
Figure 5B:
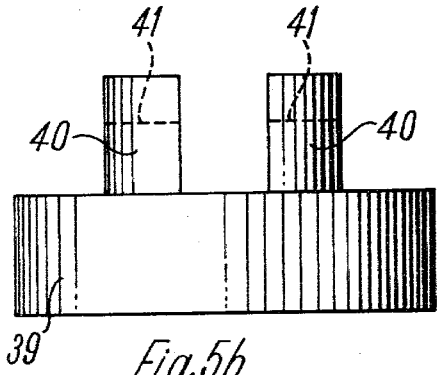
Figure 5C:
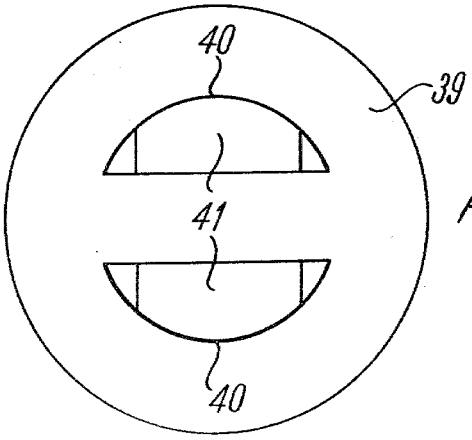

Each ejector 12 has approximately the configuration (FIG. 4*a*, 4*b*, 4*c*) of a cylindrical container or pot, at the bottom of which a blind hole 34 is provided. As may be seen in FIG. 1, a pin 35 extends into blind hole 34 and is connected at its lower end by means of a ball and socket joint with a second pin 37 which in turn is coupled with a lever 38 adjacent one end thereof. At the other end of each lever 38, in the case of the ejector 12 in the depression 10, activating handle 23 is fixedly arranged. The lever 38 is supported bearingly for rocking movement on a jack 39. Jack 39 (FIG. 5*a*, 5*b*, 5*c*) includes two lateral parts 40, each with an elongated groove 41. A pin 42 is further connected with the lever 38, pin 42 being supported in the two grooves 41, so that lever 38 may be swivelled, longitudinally shifted, and rotated in the groove. Swivelling is induced by depression of the activating handle 23. This results in upward movement of the ejector 12, whereby the ball 13 is propelled upwardly. A longitudinal displacement of the lever 38, made possible by the mobility of the pin 42 in the groove 41, results in rotation of the ejector 12 in the bore 43, because the pin 35 acts eccentrically in the blind hole 34 of the ejector 12. This determines the exit direction of a throw. The lever 38 is held in its position shown, for example, in FIG. 3 by means of a compression spring 44 (see also FIG. 1). Two springs of this type are provided for each lever, the springs pressing against a small plate 45 supporting lever 38. The springs 44 are placed in bores 46 in plates 47, which in turn are screwed against the bottom side of plate 28. Levers 38 are arranged in slits 48 in the bottom side of plates 28.

The plate 28 may be set up in the manner of a table by means of supports 49 swivelably attached to the plate 28 at the location 50. The swivel motion is limited by the stops 51.

Figure 6:
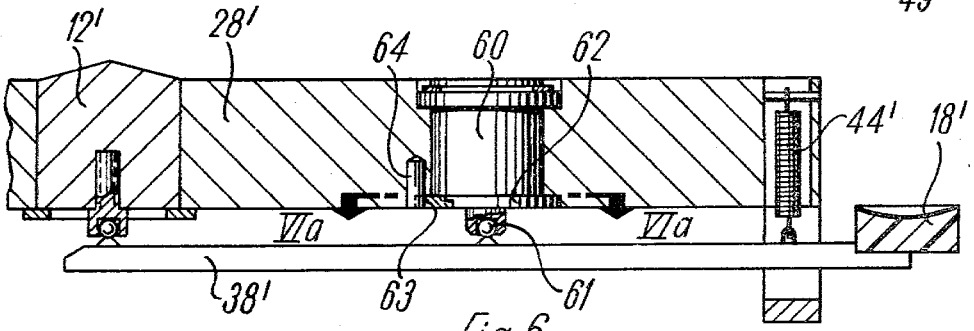
FIG. 6 is a partial section (similar to FIG. 1) through another exemplary embodiment.
Figure 6A:
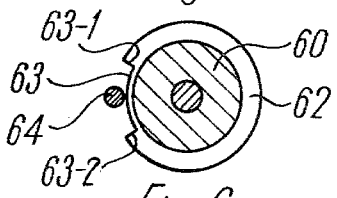
FIG. 6*a* is a section along the line VIa—VIa in FIG. 6.

In the exemplary embodiment according to FIGS. 6 and 6*a*, the levers 38' are placed not in slits, but rather are placed underneath the plate 28'. The levers are supported bearingly by means of a ball and socket joint 61 on the bottom side of a supporting body 60 rotatably set into the plate 28', the supporting body having a collar 62 including a recess 63. By means of the impact of the ends 63-1 and 63-2 of the recess 63 against a pin 64, the rotation of the supporting body 60 and thus of the ejector 12' is limited, so that it is not possible to rotate them into a position where both would be at a dead point from which they could not be rotated out. The lever 38' is held in its initial position by the tension spring 44'.

What is claimed is:

1. A basketball table game comprising:

(a) a playing field in a generally horizontal plane, said playing field having an upper surface and opposite ends;

(b) a basket goal at each said end;

(c) said upper surface of said playing field including a plurality of depressions, said depressions providing unevenness in the playing field in the vertical direction, whereby a ball placed upon the playing field always rolls into a depression;

(d) a basketball ejector in each depression, each of said ejectors including recesses for receiving a ball in a precise position; and (e) means for abruptly displacing each said ejector in the upward direction to produce a throwing motion and for rotating each said ejector to selectively determine the direction in which the ball is thrown by the abrupt upward displacement of the ejector.

2. A basketball table game according to claim 1 wherein said recesses of said ejector are in the form of grooves and are arranged obliquely with respect to the plane of the playing field.

3. A basketball table game according to claim 1, wherein said playing field is provided by a plate, a compressible material on said plate, and a cloth or plastic cover stretched over said compressible material.

4. A basketball table game according to claim 3 including table legs arranged swivelably on said plate of said playing field.

5. A basketball table game according to claim 1 including a net surrounding said playing field.

6. A basketball table game according to claim 1 wherein said displacing and selective direction determining means for each individual ejector includes a lever coupled with said individual ejector, said lever being pivotable to effect the abrupt upward displacement of the ejector and being longitudinally displaceable to effect the rotation of the ejector for selectively determining the direction in which the ball is thrown.

7. A basketball table game according to claim 6, wherein each of said ejectors is shaped for rotation with respect to the playing field, each ejector being engaged eccentrically by the associated longitudinally movable lever, whereby longitudinal displacement of the lever effects rotation of the associated ejector to, in turn, selectively determine the throwing direction.

8. A basketball table game according to claim 7, including a ball and socket joint connecting each lever with its associated ejector.

9. A basketball table game according to claim 7, including a jack coupled with each of said levers and said playing field to support each said lever for pivoting and including a depressible activating handle adjacent one end of each said lever.

10. A basketball table game according to claim 9, wherein each said jack includes a groove, the associated lever being supported in said groove so that said lever is movable in a longitudinal direction.

11. A basketball table game according to claim 9 wherein said playing field has a pair of lateral sides and wherein said depressions and said ejectors and handles associated therewith include two groups, said handles of one group being arranged at one lateral side of said playing field and said handles of the other group being arranged at the other lateral side of said playing field.

12. A basketball table game according to claim 7, including biasing means coupled with each said lever for maintaining each lever in an initial position, each said lever including an activating handle for depressing each lever from the initial position.

13. A basketball table game according to claim 7, wherein said playing field is provided by a plate, a compressible material on said plate, and a cloth or plastic cover stretched over said compressible material.

14. A basketball table game according to claim 13, including a supporting body arranged rotatably in said plate and a depressible activating handle disposed on each said lever adjacent to one end thereof.

15. A basketball table game according to claim 13, wherein said plate has a bottom side and wherein said plate includes slits on said bottom side thereof, said levers being arranged in said slits.

* * * * *